US009125501B2

(12) United States Patent
Reynolds et al.

(10) Patent No.: US 9,125,501 B2
(45) Date of Patent: Sep. 8, 2015

(54) FIXED DISPLAY PEDESTAL, SYSTEM AND/OR METHOD FOR SECURING AN ARTICLE

(75) Inventors: Andy G. Reynolds, Aurora, IL (US); Anthony Marszalek, Plainfield, IL (US); John E. Ewen, III, Aurora, IL (US); James Groth, Poplar Grove, IL (US)

(73) Assignee: Sennco Solutions, INC., Plainfield, IL (US)

( * ) Notice: Subject to any disclaimer, the term of this patent is extended or adjusted under 35 U.S.C. 154(b) by 64 days.

(21) Appl. No.: 13/557,615

(22) Filed: Jul. 25, 2012

(65) Prior Publication Data

US 2014/0027390 A1 Jan. 30, 2014

(51) Int. Cl.
*A47F 7/024* (2006.01)
*A47F 5/08* (2006.01)

(52) U.S. Cl.
CPC ..... *A47F 7/024* (2013.01); *Y10T 29/49826* (2015.01)

(58) Field of Classification Search
CPC .... A47F 5/0861; A47F 7/024; G08B 13/1445
USPC ..... 211/4; 206/560, 565, 566; 242/378, 242/378.1–378.3, 379, 404, 406; 191/12 R, 191/12.2 R; 340/568.1, 568.2, 568.3
See application file for complete search history.

(56) References Cited

U.S. PATENT DOCUMENTS 4,146,191 A * 3/1979 Cavanaugh ..... 242/379.2
4,697,537 A * 10/1987 Smith ..... 114/230.23
4,896,140 A 1/1990 Biever et al.
5,066,942 A 11/1991 Matsuo
5,072,213 A 12/1991 Close
5,124,685 A 6/1992 Rankin
5,172,098 A 12/1992 Leyden et al.
5,246,183 A * 9/1993 Leyden ..... 242/375
5,552,771 A 9/1996 Leyden et al.
5,565,848 A 10/1996 Leyden et al.
5,676,258 A 10/1997 Leyden et al.
5,861,807 A 1/1999 Leyden et al.
6,019,304 A 2/2000 Skowronski et al.
6,027,277 A 2/2000 Leyden et al.

(Continued)

FOREIGN PATENT DOCUMENTS

GB 2128790 A 5/1984

OTHER PUBLICATIONS

"The Next Generation in Display Security Vantage", Se-Kure Controls, Inc. Flyer.

(Continued)

*Primary Examiner* — Joshua Rodden
(74) *Attorney, Agent, or Firm* — Patents + TMS, P.C.

(57) ABSTRACT

A pedestal, a system and/or a method secures and/or displays an article. The pedestal secures an article to a fixture while allowing manipulation, testing and/or maneuvering of the article with respect to the pedestal and/or a surface. A drum, cable and a spring may be used to deter theft and/or removal of the article. The article may be on display and/or may be used, manipulated, tested and/or transported by consumers in an environment, such as, for example, a retail store. The pedestal may allow for extension of the cable by pulling the article away from the pedestal and/or the drum. The pedestal, the system and/or the method may allow for extension of the cable using a spring.

11 Claims, 5 Drawing Sheets

(56) References Cited

U.S. PATENT DOCUMENTS

| | | | | |
|---|---|---|---|---|
| 6,039,498 | A | 3/2000 | Leyden et al. | |
| 6,087,939 | A | 7/2000 | Leyden et al. | |
| RE37,590 | E | 3/2002 | Leyden et al. | |
| 6,386,906 | B1 | 5/2002 | Burke | |
| 6,476,717 | B1 * | 11/2002 | Gross et al. | 340/568.1 |
| 6,495,756 | B1 | 12/2002 | Burke et al. | |
| 6,616,080 | B1 * | 9/2003 | Edwards et al. | 242/378.1 |
| 6,659,382 | B2 * | 12/2003 | Ryczek | 242/379 |
| 6,756,900 | B2 | 6/2004 | Leyden et al. | |
| 6,761,579 | B2 | 7/2004 | Fort et al. | |
| 6,799,994 | B2 | 10/2004 | Burke | |
| 7,000,746 | B2 * | 2/2006 | Mackin et al. | 191/12.4 |
| 7,015,596 | B2 * | 3/2006 | Pail | 307/28 |
| 7,154,039 | B1 | 12/2006 | Marszalek et al. | |
| 7,202,417 | B2 | 4/2007 | Marszalek et al. | |
| 7,202,786 | B2 | 4/2007 | Marszalek et al. | |
| 7,209,038 | B1 * | 4/2007 | Deconinck et al. | 340/568.8 |
| 7,223,917 | B1 | 5/2007 | Marszalek et al. | |
| 7,287,652 | B2 * | 10/2007 | Scholen et al. | 211/26 |
| 7,327,276 | B1 * | 2/2008 | Deconinck et al. | 340/687 |
| 7,385,522 | B2 | 6/2008 | Belden, Jr. et al. | |
| 7,387,003 | B2 | 6/2008 | Marszalek et al. | |
| 7,487,652 | B2 | 2/2009 | Marszalek et al. | |
| 7,504,944 | B2 | 3/2009 | Marszalek et al. | |
| 7,592,548 | B2 | 9/2009 | Marszalek et al. | |
| 7,593,142 | B2 | 9/2009 | Marszalek et al. | |
| 7,626,500 | B2 * | 12/2009 | Belden et al. | 340/568.1 |
| 7,629,895 | B2 | 12/2009 | Belden, Jr. et al. | |
| 7,667,601 | B2 * | 2/2010 | Rabinowitz et al. | 340/568.2 |
| 7,714,722 | B2 | 5/2010 | Marszalek et al. | |
| D616,778 | S | 6/2010 | Marszalek et al. | |
| 7,744,404 | B1 * | 6/2010 | Henson et al. | 439/501 |
| 8,056,740 | B2 * | 11/2011 | Weshler et al. | 211/119.003 |
| 8,079,478 | B2 * | 12/2011 | Short et al. | 206/734 |
| 8,522,985 | B2 * | 9/2013 | Scholen et al. | 211/26 |
| 8,523,122 | B2 * | 9/2013 | Johnson et al. | 248/161 |
| 8,558,688 | B2 * | 10/2013 | Henson et al. | 340/539.1 |
| 8,599,021 | B2 * | 12/2013 | Belden et al. | 340/568.2 |
| 2005/0040949 | A1 * | 2/2005 | Frederiksen et al. | 340/568.2 |
| 2006/0086160 | A1 | 4/2006 | Marszalek et al. | |
| 2006/0248781 | A1 | 11/2006 | Horvath et al. | |
| 2007/0113973 | A1 | 5/2007 | Marszalek et al. | |
| 2007/0125569 | A1 | 6/2007 | Marszalek et al. | |
| 2007/0152819 | A1 * | 7/2007 | Marszalek et al. | 340/568.4 |
| 2007/0169956 | A1 | 7/2007 | Marszalek et al. | |
| 2008/0035778 | A1 * | 2/2008 | Belden et al. | 242/375 |
| 2008/0047178 | A1 | 2/2008 | Marszalek et al. | |
| 2008/0204239 | A1 | 8/2008 | Marszalek et al. | |
| 2009/0058643 | A1 | 3/2009 | Groth | |
| 2009/0266963 | A1 | 10/2009 | Marszalek et al. | |
| 2010/0301998 | A1 | 12/2010 | Marszalek et al. | |
| 2011/0084689 | A1 | 4/2011 | Groth et al. | |
| 2011/0303816 | A1 | 12/2011 | Horvath et al. | |

OTHER PUBLICATIONS

"Se-Kure Controls: Detailed Descriptions of Items Too New for Catalog", Se-Kure Controls, Inc. Website, http://www.se-kure.com/new_listings.htm.

"Se-Kure Controls: 4-Port and One-on-One Alarms", Se-Kure Controls, Inc. Website, http://www.se-kure.com/page7.htm.

"InVue Security Products USB Sensors", Promotional Flyer.

* cited by examiner

FIXED DISPLAY PEDESTAL, SYSTEM AND/OR METHOD FOR SECURING AN ARTICLE

BACKGROUND OF THE INVENTION

The present invention generally relates to a fixed display pedestal, a system and/or a method for securing and/or displaying an article. More specifically, the present invention relates to a fixed display pedestal, a system and/or a method that may be used to allow manipulation, testing and/or maneuvering of an article with respect to a fixed surface and/or the pedestal. A drum in conjunction with a spring may be used to deter a theft and/or a removal of an article, such as, for example, a bottle of perfume, cologne, or the like. The drum may be part of the fixed pedestal that may be attached to the article. The article may be on display and/or may be used, manipulated, tested and/or transported by consumers in an environment, such as, for example, a retail store. The fixed display pedestal, the system and/or the method may allow for extension of the cable by pulling the article away from the pedestal and/or the drum. The pedestal, the system and/or the method may allow for retraction of the cable using a spring. The pedestal, the system and/or the method may prevent tangling of the cable and/or may allow for repetitive extension and/or retraction of the cable. Further, a shelf may have two or more pedestals for displaying two or more articles.

It is generally known that retailers of articles provide samples of the articles that allow consumers to interact with the samples. The samples may be located on or near a display for the articles wherein pricing information and/or product availability may be displayed. Moreover, security tethers may be provided at the display to mechanically anchor the samples to the display. The samples are, secured to prevent removal, theft and/or damage. The presence of the samples may be essential to marketing and/or sales of the article. Therefore, retailers must maintain an availability of the samples and/or control of a location of the samples to allow consumers to have exposure to the articles.

Known security systems are provided and/or are used by retailers to secure a sample to its display. The known security systems mechanically and/or electrically connect the samples to the display with a cable. The cable may be, for example, a straight cable that may have mechanical tethers and/or wires therein.

Cable security systems are provided with spring actuated spools to retract the cable after release of the sample. However, known cable security systems are designed for electronic devices, such as digital cameras or mobile phones. As such, the cable often requires a bulky adapter to be fixed onto the device. Furthermore, the cables which secure the device often prevent a customer and/or a user from manipulating and/or examining the device. The device is often fixed to a surface of the fixture. Accordingly, the customer and/or the user may not be able to pick up and/or to move the device to examine the device, and its various characteristics of the device, such as, for example, the weight, the texture, the feel, the configuration of the device and/or the like. Known security systems that position the cable on the display are often aesthetically displeasing and/or are prone to kinking, to twisting and/or to tangling during repetitive use.

Many of the security systems that are available are designed with particular products in mind. For example, a security display for a mobile phone may be accompanied with an adapter that may only fit certain mobile phones. Furthermore, known cable security systems fail to accommodate non-electronic and/or uniquely shaped items. Many luxury retail stores display expensive items, but do not allow customers to handle the items for security purposes. Thus, many items are displayed behind security glass or not displayed at all. A potential buyer may base his or her purchasing decision on whether the item may handled and/or tested.

Likewise, many retail stores display "testers" of luxury items such as perfume, cologne and/or cosmetics. Known security systems often fail to prevent and/or deter a consumer from removing and/or stealing a tester item. The lack of available security systems may especially hinder the sale of expensive perfumes and colognes because potential buyer may not be able to test and/or sample the fragrance prior to buying.

A need, therefore, exists for a fixed display pedestal, a system and/or a method for securing and/or displaying an article. Further, a need exists for a pedestal, a system and/or a method that may prevent snagging, twisting, kinking and/or tangling of the cable. Furthermore, a need exists for a pedestal, a system and/or a method that may allow for repetitive extension and/or retraction of the cable. Moreover, a need exists for a pedestal, a system and/or a method that may be mountable to a surface for use. And, a need exists for a pedestal, a system and/or a method that may provide a minimalistic aesthetic quality to a display for securing an article. Additionally, a need exists for a pedestal, a system and/or a method that may have interchangeable components to allow for customization of a security solution. Further, a need exists for a pedestal, a system and/or a method that may allow the articles to be installed, replaced and/or exchanged. Still further, a need exists for a pedestal, a system and/or a method that may accommodate various shapes and/or sizes of articles. Moreover, a need exists for a pedestal, a system and/or a method that may prevent friction wear from the cable on portions of the pedestal. Furthermore, a need exists for a pedestal, a system and/or a method for displaying multiple items on a shelf.

SUMMARY OF THE INVENTION

The present invention generally relates to a fixed display pedestal, a system and/or a method for securing and/or displaying an article. More specifically, the present invention relates to a fixed display pedestal, a system and/or a method that may be used to allow manipulation, testing and/or maneuvering of an article with respect to a fixed surface and/or the pedestal. A drum in conjunction with a spring may be used to deter a theft and/or a removal of an article, such as, for example, a bottle of perfume, cologne, or the like. The drum may be part of the fixed pedestal that may be attached to the article with adhesive. The article may be on display and/or may be used, manipulated, tested and/or transported by consumers in an environment, such as, for example, a retail store. The fixed display pedestal, the system and/or the method may allow for extension of the cable by pulling the article away from the pedestal and/or the drum. The pedestal, the system and/or the method may allow for retraction of the cable using a spring. The pedestal, the system and/or the method may prevent tangling of the cable and/or may allow for repetitive extension and/or retraction of the cable. Further, A shelf may have two or more pedestals for displaying two or more articles.

The pedestal, the system and/or the method may have a drum within the fixture. The drum may be generally cylindrical about a central axis of the drum. A spring, such as a constant force spring, may be rotatably coupled to the drum. The spring may apply constant torsional and/or rotational force to the drum. The drum may have a slot for attaching the first end of a cable to the drum. The cable may be wrapped, for example, at least one revolution around the drum. The second end of the cable may extend from the drum towards and/or through an aperture in the pedestal where the drum may be attached to the pedestal. The second end of the cable may have a knot and/or end piece for affixing the article to the a seat and/or the pedestal.

A user may maneuver the article to a position away from the pedestal. By pulling the article, the cable that may be attached to the article may extend and/or may rotate the drum as the cable may be extended. When the user may maneuver the article towards the pedestal and/or may release the article, the spring may draw the first end of the cable and/or the article towards the pedestal. As a result, a length of the cable may be spooled on the drum when the article is not being manipulated, tested and/or maneuvered by the user.

To this end, in an embodiment of the present invention, a display pedestal for tethering and/or securing an article is provided. The display pedestal has a body having a bottom surface and a top surface wherein the top surface is planar having a recess disposed therein and further wherein the recess has an aperture. Further, the display pedestal has a seat that rests in the recess wherein the seat is shaped to conform to the recess. Moreover, the display pedestal has a cable extending through the aperture in the recess and may be secured to the seat.

In an embodiment, the cable is extendable and retractable into an interior of the body.

In an embodiment, the display pedestal has a drum inside the body wherein the drum spools the cable.

In an embodiment, the display pedestal has a spring in communication with the drum to apply force to the cable.

In an embodiment, the display pedestal has an adhesive disposed on the seat.

In an embodiment, the top surface of the seat is coplanar with the top surface of the body.

In an embodiment, the display pedestal has a slot on the seat for tethering the cable.

In another embodiment, a method for securing an article to a surface is provided. The method has the step of providing a pedestal having an interior and further having a recess with a seat wherein the seat is attached to a cable that is extendable from the interior of the pedestal. Further, the method has the step of mounting the pedestal to the surface. Still further, the method has the step of affixing the seat to the article. Moreover, the method has the step of positioning the seat into the recess such that the article stands on the pedestal.

In an embodiment, a rotatable drum is disposed in the interior of the pedestal wherein the rotatable drum spools the cable.

In an embodiment, the method has the step of spooling the cable onto a rotatable drum disposed in the interior of the pedestal wherein the drum is in rotational communication with a constant force spring that may apply a force to the cable.

In another embodiment, a system for displaying a plurality of articles is provided. The system has a plurality of pedestals wherein each of the pedestals has an interior and a recess with a seat wherein the seat is attached to a cable that is extendable from the interior of the pedestal and further wherein the seat is adapted to connect to an article of the plurality of articles.

In an embodiment, the system has a means for fastening the shelf to a surface.

In an embodiment, the system has a drum for spooling the cable wherein the drum is disposed in the pedestal and further wherein the drum is in rotational communication with a spring to apply a force to the cable.

In an embodiment, the plurality of pedestals are arranged in parallel in the shelf.

In an embodiment, the system has an adhesive on the seat of each of the pedestals.

In an embodiment, each of the pedestals is U-shaped.

It is, therefore, an advantage of the present invention to provide a fixed display pedestal, a system and/or a method for securing and/or displaying an article.

Another advantage of the present invention is to provide a fixed display pedestal, a system and/or a method for extending and/or retracting a cable that may be used to allow manipulation, testing and/or maneuvering of an article with respect to a surface.

And, another advantage of the present invention is to provide a fixed display pedestal, a system and/or a method for extending and/or retracting a cable that may be used to deter theft and/or removal of an article, such as, for example, a perfume bottle, a cologne bottle, a cosmetic and/or any combination thereof from a fixture.

Yet another advantage of the present invention is to provide a fixed display pedestal, a system and/or a method that has a shelf for displaying articles in an environment.

A further advantage of the present invention is to provide a fixed display pedestal, a system and/or a method for extending and/or retracting a cable that may allow for extension of the cable while displacing the article away from the pedestal.

Moreover, an advantage of the present invention is to provide a fixed display pedestal, a system and/or a method for extending and/or retracting a cable that may allow for retraction of the cable using a spring in the pedestal.

And, another advantage of the present invention is to provide a fixed display pedestal, a system and/or a method for extending and/or retracting a cable that may prevent snagging, twisting, kinking and/or tangling of the cable.

Yet another advantage of the present invention is to provide a fixed display pedestal, a system and/or a method for extending and/or retracting a cable that may allow for repetitive extension and/or retraction of the cable.

Another advantage of the present invention is to provide a fixed display pedestal, a system and/or a method for extending and/or retracting a cable that may be mountable to a surface.

Yet another advantage of the present invention is to provide a fixed display pedestal, a system and/or a method for extending and/or retracting a cable that may be disposed within a pedestal display for an article that may secure the article to the pedestal.

A still further advantage of the present invention is to provide a display pedestal, a system and/or a method for extending and/or retracting a cable that may provide a minimalistic aesthetic quality to a display for securing an article.

Moreover, an advantage of the present invention is to provide a display pedestal, a system and/or a method for extending and/or retracting a cable that may have interchangeable components to allow for customization of a security solution.

Yet another advantage of the present invention is to provide a display pedestal, a system and/or a method for extending and/or retracting a cable that may allow the article and/or pedestal to be quickly installed, replaced and/or exchanged.

Moreover, an advantage of the present invention is to provide a display pedestal, a system and/or a method for extending and/or retracting a cable that may accommodate articles of varying types, sizes, and/or shapes.

Additional features and advantages of the present invention are described in, and will be apparent from, the detailed description of the presently preferred embodiments and from the drawings.

DETAILED DESCRIPTION OF THE PRESENTLY PREFERRED EMBODIMENTS

Figure 1:
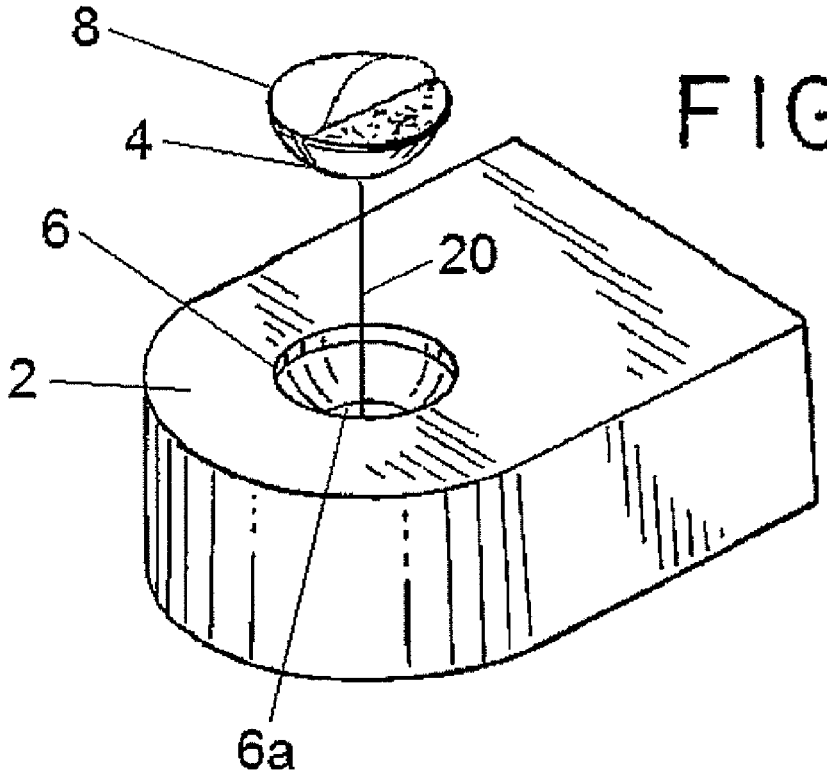
FIG. 1 illustrates a perspective view of a security display pedestal and a system for extending and/or retracting a cable in an embodiment of the present invention.

The present invention generally relates to a fixed display pedestal, a system and/or a method for securing and/or displaying an article. More specifically, the present invention relates to a fixed display stage, a system and/or a method that may be used to allow manipulation, testing and/or maneuvering of an article with respect to a fixture. A cable, drum and spring may be used to prevent a theft and/or a removal of an article, such as, for example, a bottle of perfume, cologne, cosmetic, and/or the like. The drum may be part of a fixed pedestal that may be attached to the article. The article may be on display and/or may be used, manipulated, tested and/or transported by consumers in an environment, such as, for example, a retail store. The fixed display pedestal, the system and/or the method may allow for extension of the cable by pulling the article away from the pedestal. The fixed display pedestal, the system and/or the method may allow for retraction of the cable using a spring. The fixed display pedestal, the system and/or the method may prevent tangling of the cable and/or may allow for repetitive extension and/or retraction of the cable.

Referring now to the drawings wherein like numerals refer to like parts, FIGS. 1-5 illustrate a security display pedestal 2 (herein "pedestal 2"), a seat 4 and/or components of the pedestal 2 and/or of the system for extending and/or retracting a cable 20. The pedestal 2 may be attached to a counter-top, shelf, or any other surface. The pedestal 2 may be used for displaying an article and/or for securing the article to the surface in embodiments of the present invention. In an embodiment, the article may be a cosmetic good in a bottle, tube and/or container, such as, for example, perfume, cologne, skin-care creams, lotions, eye makeup, powders, lipsticks, fingernail polish, hair sprays and/or the like. The article may be on display and/or may be used, manipulated, tested and/or transported by a consumer or consumers in an environment, such as, for example, a retail store. The present invention should not be deemed as limited to a specific embodiment of the article. It should be understood that the article may be any article that may be sold and/or displayed in an environment offering any article, product and/or other merchandise as known to one having ordinary skill in the art.

The cable 20 may be part of a system for tethering the article to the pedestal 2 and/or for monitoring an attachment of the article to the pedestal 2. The cable 20 may have a length defined between a first end and a second end that may be positioned opposite to the first end. The first end of the cable 20 may extend through the pedestal 2 and around a drum 10 that may be disposed inside the pedestal 2. The first end may be affixed to the drum and/or some other point inside the pedestal 2. The second end of the cable 20 may be attached and/or harnessed to a seat 4 and/or to the article.

FIGS. 1-5 generally illustrate embodiments of the pedestal 2 and/or the system. As shown in FIG. 1, the pedestal 2 may have a seat 4 and/or a cable 20. The seat 4 may rest in a recess 6 that may be disposed on the exterior of the pedestal 2. The hollow recess 6 may have an aperture 6*a* through which the cable 20 may be extended. The size of the aperture 6*a* may be comparable to the size of the cable 20. The exterior of the pedestal 2 may be hollow and/or may contain various parts inside. In FIG. 1, the seat 4 is shown extended from the pedestal 2. The cable 20 may tether the seat 4 to the pedestal 2 using an extendable and/or retractable mechanism. The seat 4 may be adapted to be releasably attached to an article.

Thus, the article and the seat 4 may be used, manipulated, tested and/or transported by consumers in and/or around the general vicinity of the pedestal 2. The seat 4 may have an adhesive B. The adhesive 8 may be adhered to the top surface of the seat 4. The adhesive 8 may have a glue on a top surface and/or a bottom surface thereof. The adhesive 8 may have a peelable film 8*a* that may be removed prior to placing an article on the seat 4 and/or the pedestal 2. The pedestal 2 may be affixed to a surface. The adhesive 8 may be, for example, a double-sided bonding tape, such as, for example, VHB® Tape. VHB® is a registered trade mark of 3M Company.

Figure 2:
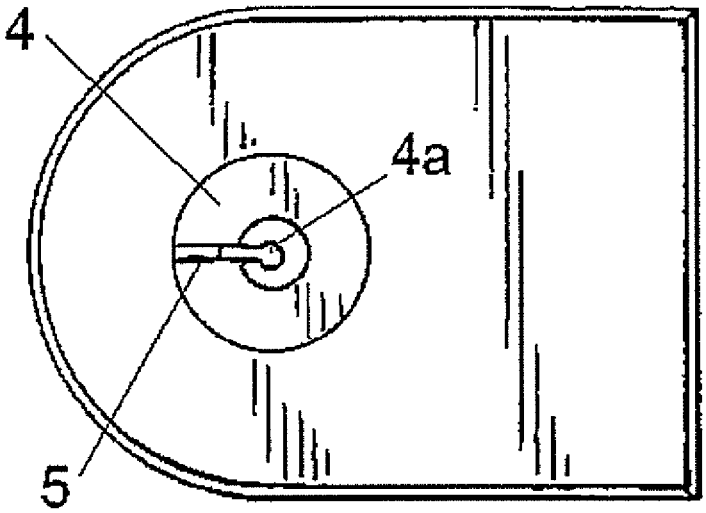
FIG. 2 illustrates a top plan view of a security display pedestal and a system for extending and/or retracting a cable in an embodiment of the present invention.

FIG. 2 illustrates a top plan view of a security display stage and a system for extending and/or retracting a cable in an embodiment of the present invention. The pedestal 2 may be generally U-shaped. The pedestal 2 may have two right angles forming a first edge and/or a rounded second edge. The pedestal 2 may be a stage and/or may display the article that may be secured.

The seat 4 may rest in the hollow recess 6 when the article is stationary and/or standing. In the resting position, the cable 20 may be retracted into the pedestal 2. The shape of the seat 4 may correspond to the hollow recess 6 such that the seat fits into the recess 6. The seat 4 and the recess 6 may generally have hemispherical shapes. In the resting position, the top of the seat 4 and the top surface of the pedestal 2 may be substantially flush and/or coplanar. In the resting position, the article may appear to be resting and/or sitting on top of the pedestal 2.

The seat 4 may have a slot 5 that may be used to attach and/or detach the first end of the cable 20 from the seat 4. As such, the first end of the cable 20 may have a knot (not shown) and/or an end piece (not shown) for connecting and/or disconnecting the cable 20 to and/or from the seat 4. The end piece may be generally cylindrical in shape. When the cable 20 is fit through the slot 5, the end piece may be positioned to rest within the seat 4 with the cable 20 extending through an aperture 4*a* in the base of the seat 4. The seat 4 may have any other type of affixing mechanism for attaching an article to a top surface thereof. For example, an adhesive 8 may be used to adhere the article to the top surface of the seat 4.

Figure 3:
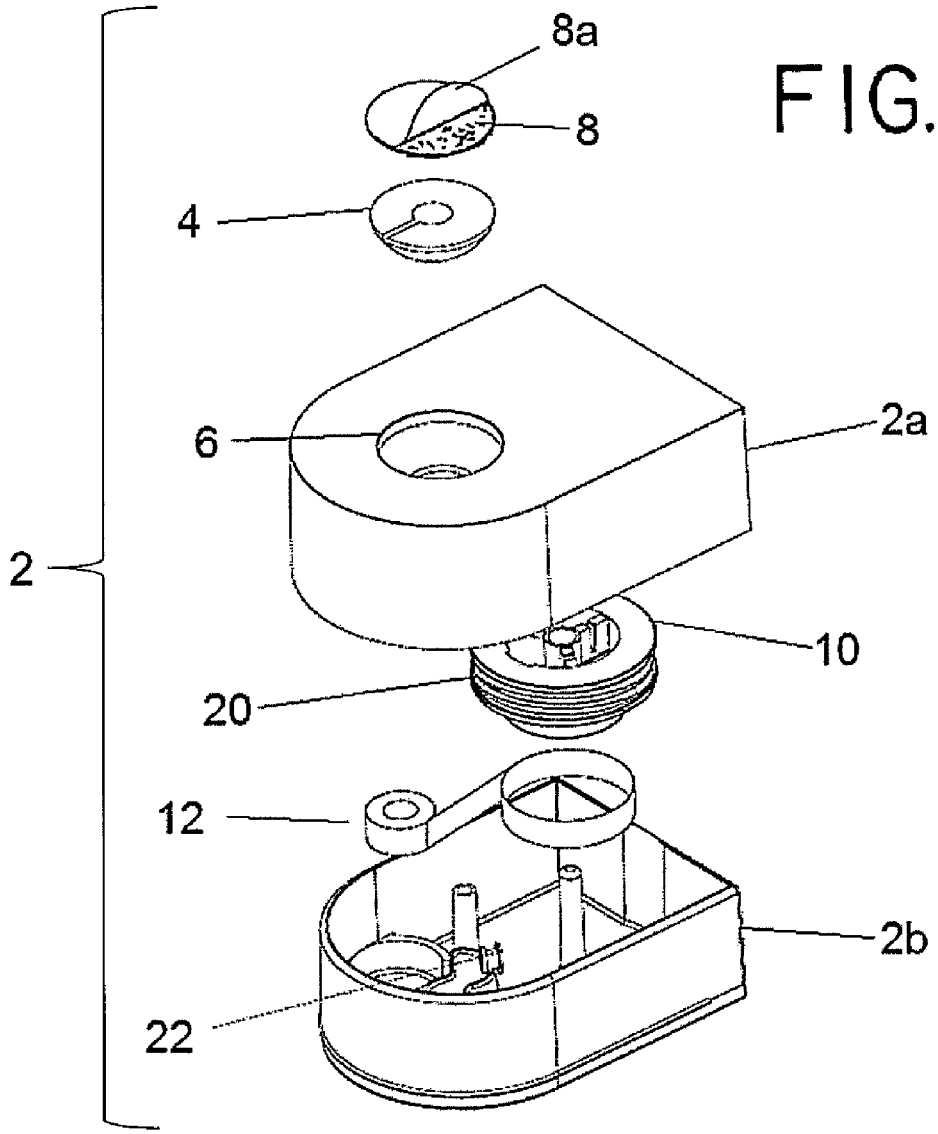
FIG. 3 illustrates an exploded view of a security display pedestal and a system for extending and/or retracting a cable in an embodiment of the present invention.

FIG. 3 illustrates an exploded view of a security display stage and a system for extending and/or retracting the cable 20 in an embodiment of the present invention. As shown, the pedestal 2 may be formed of a top portion 2*a* and a base portion 2*b*. The top portion 2*a* and the base portion 2*b* may enclose the drum 10, the cable 20, a spring 12, and/or a grommet 22.

As shown in FIG. 3, a drum 10 may be provided for spooling the cable 20. The drum 10 may have a length defined between a first end and a second end that may be positioned opposite to the first end. The drum 10 may be cylindrical about a central axis of the drum 10 between the first end and the second end. The drum 10 may have an internal diameter and an external diameter. The drum 10 may be attached to and/or may be integrally formed with a fixed axle at a junction point that may be approximately half way between the first end of the drum 10 and the second end of the drum 10. The axle may be used to attach the drum 10 to the interior of the pedestal 2. The drum 10 may be constructed from a material, such as, for example, steel, aluminum, plastic and/or the like that may secure the article to the pedestal 2. The drum 10 may have an upper flange and a lower flange between which the cable 20 may be stored. The flanges may ensure that the cable 20 may be spooled to the drum 10 during retraction of the cable 20. The flanges may extend radially from the first end and the second end of the drum 10. The flanges may prevent the cable 20 from slipping from the first end or the second end of the drum 10.

As shown in FIG. 3, the drum 10 and/or the pedestal 2 may have a spring 12. The spring 12 may be a constant force spring having a rolled ribbon such that the spring is relaxed when coiled. As the spring 12 becomes unrolled, the restoring force may come from the portion of the ribbon near the roll. As the spring 12 unrolls, the resulting force is nearly constant. The spring 12 may be constructed from a material, such as, for example, steel, aluminum, plastic and/or the like that may be suitable for applying a force.

The rolled ribbon of the spring 12 may have a length defined between a first end and a second end that may be positioned opposite to the first end. The first end may be positioned and/or fixed around a portion of the drum 10 such that a constant rotational force is applied to the drum 10. The rotational force may cause the cable 20 to be retracted into the pedestal 2 absent any other force, such as that of a user pulling the cable 20 from the pedestal 2 via the seat 4. When the seat 4 is situated in the resting position, the tension in the cable 20 is the force that may be restricting the spring 12. The second end of the rolled ribbon may be fixed to a portion of the interior of the pedestal and/or may be positioned in a cylindrical recess.

As shown in FIG. 3, the pedestal 2 may have a grommet 22 that may be used to guide the cable 20 through the aperture 6*a* and/or onto the drum 10. The grommet 22 may be constructed from a material, such as, for example, steel, aluminum, plastic and/or the like. The grommet 22 may be affixed to a point in the base portion 2*b* of the pedestal 2.

Figure 4:
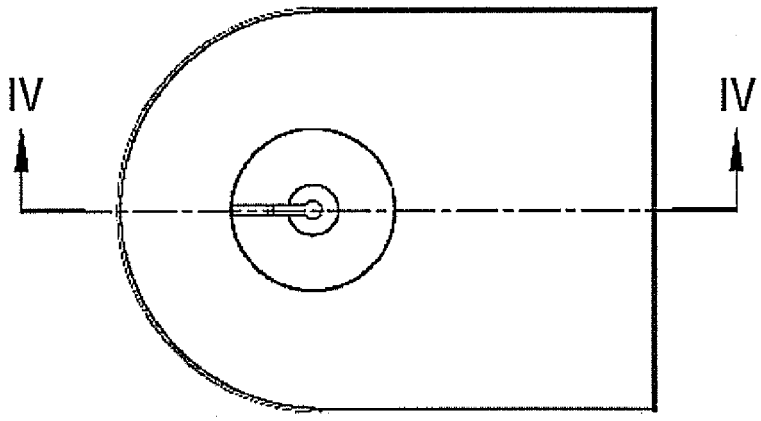
FIG. 4 illustrates a top plan view of a security display pedestal and a system for extending and/or retracting a cable in an embodiment of the present invention.
Figure 5:
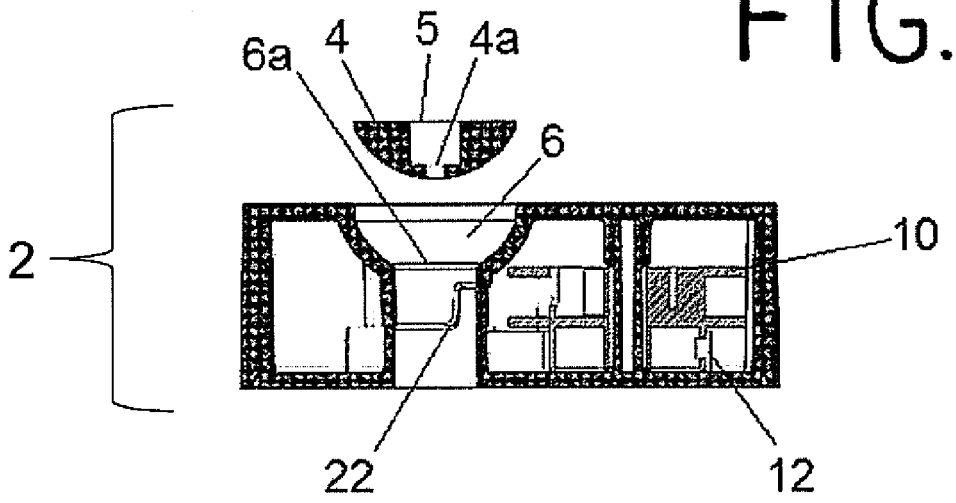
FIG. 5 illustrates a partial cross-sectional view taken generally along line IV-IV of FIG. 4.

FIG. 5 illustrates a partial cross-sectional view taken generally along line IV-IV of FIG. 4. As shown, the drum 10 may be placed at a skewed position with respect to the recess 6 and the aperture 6*a*. The grommet 22 may be positioned directly below the aperture 6*a* to prevent the sides of the cable 20 from rubbing against the sides of the aperture 6*a* and/or the recess 6. Furthermore, the grommet 22 may be positioned parallel to the drum 10 to ensure spooling of the cable 20 onto the drum 10. As shown, the shape of the seat 4 substantially corresponds to the hollow recess 6 such that the seat 4 may fit into the recess 6. The seat 4 and the recess 6 may generally have hemispherical shapes. In the resting position, the top of the seat 4 and the top surface of the pedestal 2 may be substantially flush and/or coplanar. In the resting position, the article may conceal the seat 4 and/or the article may appear to be resting on the top surface of pedestal 2.

The pedestal 2 has a height that may vary according to application. Generally, the length and the width of the pedestal 2 may be less than the height of the pedestal 2. The pedestal 2 may have a relatively wide footprint. The base portion 2*b* of the pedestal 2 may have a mechanism for affixing the pedestal 2 to a surface. For example, an adhesive 8 and/or a glue may be used to affix the pedestal 2 to a surface. For increased strength, a fastener, such as a screw or a nail, may be driven through the base portion 2*b* into the mounting surface before the top portion 2*a* is fastened onto the base portion 2*b*.

A user of the pedestal 2 may install and/or may use the pedestal 2 on a surface in several ways. The base portion 2*b* of the pedestal 2 may be fastened and/or adhered to the mounting surface. After the pedestal 2 is affixed to the mounting surface, the first end of the cable 20 may be inserted through the recess 6 and/or aperture 6*a* and/or through the grommet 22. The first end of the cable 20 may be wrapped around the drum 10. The user may adjust slack in the cable 20 by allowing the cable 20 to be retracted. The first end of the cable 20 may be seated into and/or fixed to a portion of the drum 10 to hold the first end of the cable 20 on the drum 10. The flanges of the drum 10 may prevent the cable 20 from sliding from the drum 10. The end piece of the second end of the cable 20 may be connected to the seat 4 via the slot 5. Upon connection, the cable 20 may extend from the bottom of the seat 4. Moreover, the force from the spring 12 may pull on the cable 20 such that the seat 4 may be pulled into the recess 6 by the end piece. The top surface of the seat 4 may be affixed to the article using a fastener, a fitting, an adapter, and/or an adhesive.

After the article is attached, the user may maneuver the article and/or the seat 4 with respect to the mounting surface and/or the pedestal 2. As the article is displaced from the pedestal 2, the cable 20 may extend and/or may feed from the drum 10 through the hollow recess 6 and/or the aperture 6*a* in the pedestal 2. As the cable 20 may extend, the drum 10 may rotate around the axle to assist in extension of the second end of the cable 20 from the pedestal 2. When the article is displaced towards the pedestal 2 and/or released, a recoil action of the spring 12 may retract the cable 20 into the pedestal 2 and onto the drum 10. During retraction, the drum 10 may rotate to assist in retracting the second end of the cable 20 towards the pedestal 2.

Figure 6A:
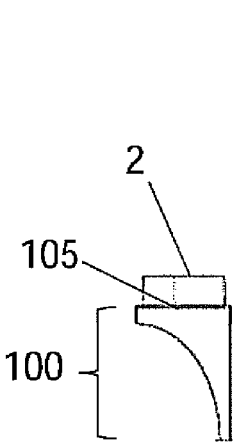
FIG. 6A illustrates a side elevation view of a shelf in an embodiment of the present invention.
Figure 6B:
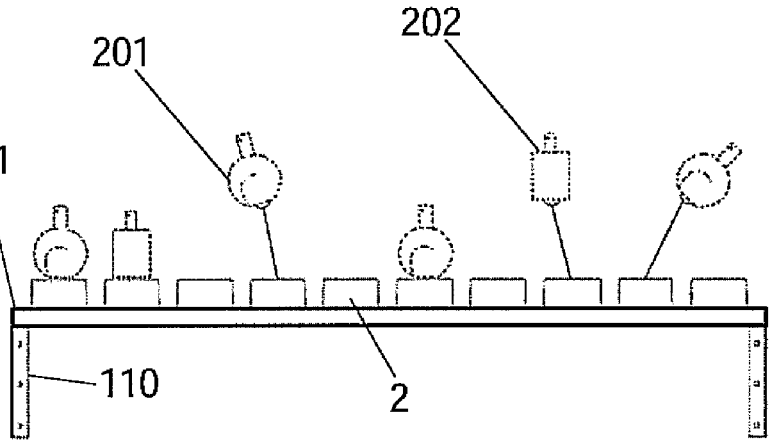
FIG. 6B illustrates a front elevation view of a shelf with multiple security display pedestals in an embodiment of the present invention.
Figure 6C:
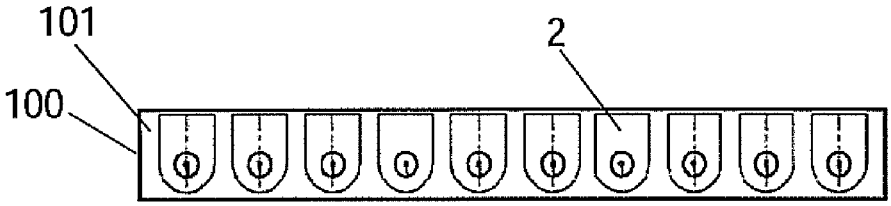
FIG. 6C illustrates a top plan view of a shelf with multiple security display pedestals in an embodiment of the present invention.

FIGS. 6A, 6B and 6C generally illustrate a display shelf 100 with multiple pedestals 2 of an embodiment of the present invention. Two or more pedestals 2 may be arranged on a shelf and/or a plank. The pedestals 2 may be individually fixed to the surface 101 of the shelf 100. The pedestals 2 may be affixed to the shelf 100 using a fastening means 105. The fastening means 105 may be, for example, bonding tape, fasteners, and/or cement. The bonding tape may be any double sided tape, such as, for example, VHB® Tape. VHB® is a registered trade mark of 3M Company. The shelf 100 may be displayed and/or mounted in an environment, such as, for example, a retail store. The shelf 100 may be affixed to a wall and/or surface using a support 110 and/or fasteners. The fasteners may be, for example, screws, nails, nuts, and/or bolts. The pedestals 2 may each display a different article 201, 202. For example, series of articles, such as a series of multiple types of perfume, may be displayed on the shelf 100. Thus, the shelf 100 may accommodate a first article 201 of a first shape and/or size, and a second article 202 of a second shape and/or size. However, it should be understood that the article may be any item and/or product that may be sold and/or displayed in an environment offering any article, product and/or other merchandise as known to one having ordinary skill in the art.

Each of the pedestals 2 on the shelf 100 may be constructed according to the description of FIGS. 1-5. It should be understood that the pedestals 2 may be of different shapes and/or sizes such as may be known to one having ordinary skill in the art. Likewise, any number of pedestals 2 may be used, and the pedestals 2 may be arranged in any order and/or configuration.

It should be understood that various changes and modifications to the presently preferred embodiments described herein will be apparent to those skilled in the art. Such changes and modifications may be made without departing from the spirit and scope of the present invention and without diminishing its attendant advantages. It is, therefore, intended that such changes and modifications be covered by the appended claims.

We claim:

1. A display pedestal for securing an article, the display pedestal comprising:

a body having a top surface, a bottom surface and walls wherein the top surface and the bottom surface are substantially parallel and the walls connect the top surface to the bottom surface to define an interior cavity wherein the body has a recess that is concave with respect to the top surface wherein the recess extends from the top surface into the interior cavity and further wherein the recess has an aperture;

a drum in the interior cavity;

an axle in the interior cavity wherein the drum rotates around the axle and further wherein the axle extends substantially perpendicular between the top surface and the bottom surface of the body;

a cable having a length defined between a first end and a second end wherein the first end is secured to the drum and further wherein the cable extends through the aperture;

a spring in the interior cavity and connected to the drum; and a seat having a slot surface that is planar and an exterior surface that is convex wherein the seat attaches to the second end of the cable wherein the exterior surface of the seat is shaped to sit within the recess in a first position and further wherein the slot surface of the seat is substantially coplanar with the top surface of the body in the first position wherein the spring applies a rotational force to the drum to maintain the seat in the first position and further wherein the seat extends vertically from the top surface in a second position.

2. The display pedestal of claim 1 further comprising:

a grommet to guide the cable from the drum through the aperture in the recess wherein the grommet is positioned below the aperture in the recess to prevent the cable from contacting the aperture in the recess.

3. The display pedestal of claim 1 further comprising:

an adhesive on the seat.

4. The display pedestal of claim 1 wherein the body is U-shaped.

5. A system for securely displaying a plurality of articles, the system comprising:

a shelf that is substantially horizontal; and a plurality of pedestals on the shelf wherein each of the plurality of pedestals has a body, a drum, a cable, an axle, a spring and a seat wherein the body has a top surface substantially parallel to the shelf, a bottom surface and sides connecting the top surface and the bottom surface to define an interior wherein a recess extends from the top surface into the interior wherein the cable has a length defined between a first end and a second end wherein the first end is secured to the drum and rotates around the drum wherein the drum is connected to the axle and rotates around the axle wherein the axle extends substantially perpendicular between the top surface and the bottom surface of the body wherein the spring cooperates with the drum wherein the second end of the cable is connected to the seat wherein the seat has a first surface that is planar and that is coplanar with the top surface of the body in a first position wherein the seat is shaped to sit within the recess in the first position and further wherein the seat extends from top surface of the body in a vertical direction with respect to the top surface of the body and to the shelf in a second position of the seat.

6. The system of claim 5 further comprising:

a fastening means to connect the shelf to a surface.

7. The system of claim 5 wherein the drum spools the cable.

8. The system of claim 5 wherein the plurality of pedestals are linearly arranged with respect to each other on the shelf.

9. The system of claim 5 further comprising:

an adhesive on the seat of each of the plurality of pedestals.

10. The system of claim 5 wherein each of the plurality of pedestals is U-shaped.

11. The system of claim 5 further comprising:

an adhesive for affixing each of the plurality of pedestals to the shelf.

* * * * *